US012241713B2

(12) United States Patent
Gardner, Jr. et al.

(10) Patent No.: US 12,241,713 B2
(45) Date of Patent: Mar. 4, 2025

(54) BALANCED FIRING VALVE FOR AIR GUN

(71) Applicant: Gardner and Gardner Realty Co., Inc., Loyalhanna, PA (US)

(72) Inventors: William M. Gardner, Jr., Loyalhanna, PA (US); Hans Semelsberger, Loyalhanna, PA (US)

( * ) Notice: Subject to any disclaimer, the term of this patent is extended or adjusted under 35 U.S.C. 154(b) by 98 days.

(21) Appl. No.: 18/229,468

(22) Filed: Aug. 2, 2023

(65) Prior Publication Data

US 2024/0060745 A1 Feb. 22, 2024

Related U.S. Application Data

(60) Provisional application No. 63/399,335, filed on Aug. 19, 2022.

(51) Int. Cl.
*F41B 11/723* (2013.01)
*F41B 11/73* (2013.01)

(52) U.S. Cl.
CPC ..... *F41B 11/723* (2013.01); *F41B 11/73* (2013.01)

(58) Field of Classification Search
CPC ..... F41B 11/723; F41B 11/73
See application file for complete search history.

(56) References Cited

U.S. PATENT DOCUMENTS 9,638,490 B1 * 5/2017 Shen ..... F41B 11/723
2006/0011187 A1 * 1/2006 Gardner, Jr. ..... F41B 11/62 124/73

* cited by examiner

*Primary Examiner* — Jonathan C Weber
(74) *Attorney, Agent, or Firm* — Craig Rogers; SIMPLE IP Law PC

(57) ABSTRACT

A valve for a pneumatic gun includes a valve stem arranged through a compressed gas storage area that is configured to store a quantity of high-pressure compressed gas for a firing operation. A valve plug is arranged on an end of the valve stem and seals an air port that is configured to communicate compressed gas from a compressed gas storage area to a breech. A piston is arranged on the valve stem, wherein one end of the piston receives a quantity of low-pressure compressed gas from a solenoid to initiate the firing operation of the pneumatic gun. An air through-port is arranged through the valve stem and communicates high-pressure compressed gas from the firing operation to an end of the piston to assist in closing the valve plug. A pneumatic gun and method of operating are also provided.

20 Claims, 2 Drawing Sheets

BALANCED FIRING VALVE FOR AIR GUN

PRIORITY CLAIM

This application is a non-provisional of and claims priority from U.S. Provisional Patent Application Ser. No. 63/399,335, filed Aug. 19, 2022, the contents of which are incorporated herein by reference in their entirety.

BACKGROUND OF THE INVENTION

Field of the Invention

This invention relates generally to air guns. More particularly, this invention relates to a pneumatic firing valve design for an air gun.

Related Art

Pneumatic air guns such as airsoft guns, bb guns, pellet guns, paintball guns, and the like, use firing valves to release high-pressure compressed gas into contact with the projectile to fire the projectile from the gun toward the target. The firing valves may include pins impacted by a hammer or they may be operated pneumatically through a solenoid valve or other mechanism. Unfortunately, conventional firing valves for air guns may require a large amount of force to actuate, may stay open too long, and may be inefficient and allow excess amounts of compressed gas to flow through the valve during the firing operation. What is needed is an air gun firing valve that opens and closes easily and provides an efficient use of the compressed gas during a firing operation.

SUMMARY OF THE INVENTION

According to various embodiments and principles of the present invention, a firing valve for an air gun comprises a substantially or completely balanced valve stem that requires very little pressure to operate (i.e., move from a closed to open position). The valve stem can be provided with a small amount of forward bias (e.g., spring or air bias) to close the firing valve, or it can be completely balanced with neither a forward nor rearward bias.

In one embodiment, a forward (or rearward) end of the valve stem is connected to a poppet valve that operates to selectively trap and release high-pressure compressed gas from a compressed gas storage area for the firing operation. A rearward (or forward) end of the valve stem preferably comprises a piston having a forward (or rearward) actuating surface in communication with an air port that receives compressed gas from a solenoid valve. The solenoid valve actuates the firing valve by directing a low-pressure gas to the actuating surface of the firing valve piston in response to a trigger pull.

The valve stem comprises an air through port extending from a forward end of the valve stem to a rearward end of the valve stem that permits high-pressure compressed gas from the firing operation to assist in closing the firing valve. When the firing valve is actuated, most of the compressed gas released through the firing valve travels through one or more air ports to the breech of the air gun to force a projectile from the barrel. However, some of the compressed gas from the compressed gas storage area releases rearward (or forward) through the air through port in the valve stem and provides a force on a rearward (or forward) surface area of the piston arranged at the rearward (or forward) end of the valve stem to close the firing valve.

By using some of the high-pressure gas from the firing operation to close the poppet valve, the firing valve can be closed even against actuating pressure operating from the solenoid valve. This permits the firing valve to be closed faster and thereby conserves compressed gas and operates the air gun more efficiently.

According to other aspects of the present inventive concepts, the firing valve can include a larger poppet valve compared to conventional firing valves. The larger poppet valve enables a quicker release of the high-pressure compressed gas through the firing valve.

Of course, the inventive principles are not limited to the specific embodiments disclosed herein, and various aspects, embodiments, and configurations of this invention are possible without departing from the principles disclosed herein. This invention is therefore not limited to any of the particular aspects, embodiments, or configurations described herein.

For example, the valve poppet (plug) could be moved closer to the barrel and/or a straighter path could be provided between the firing valve and the breech of the air gun to reduce or eliminate bends or turns between the firing valve and the breech. In one embodiment, the firing valve could be moved up into the air transfer port between the compressed gas storage area and the breech. In another embodiment, the firing valve could be arranged directly behind the breech in an extension of the breech chamber. Other embodiments could be used to reduce or eliminate air turns and improve efficiency.

Furthermore, the air gun could be made semi- or full-auto by adding an automatic loading function to the air gun. A separate solenoid could be provided, for instance to operate a bolt for the loading function. The separate solenoid could be open or closed biased depending on the desired operation of the bolt.

In addition, relative terms, such as forward, rearward, upper, lower, etc., could be swapped depending upon the orientation of the device or features without affecting the principles of the present inventive concepts. Numerous other changes or additions could be made to the air gun without departing from the principles of the present inventive concepts.

BRIEF DESCRIPTION OF DRAWINGS

The foregoing and additional objects, features, and advantages of the present invention will become more readily apparent from the following detailed description of preferred embodiments, made with reference to the accompanying drawings, in which.

DETAILED DESCRIPTION OF ILLUSTRATIVE EMBODIMENTS

Embodiments of the present inventive concepts are shown in the accompanying drawings to illustrate various features, benefits, and configurations thereof. Additional features, benefits, and configurations will be readily apparent to those of ordinary skill in the art based on this disclosure, and all such features, benefits, and configurations are considered within the scope of the present invention. Various illustrative embodiments will now be described in further detail in connection with the accompanying drawing(s).

Figure 1:
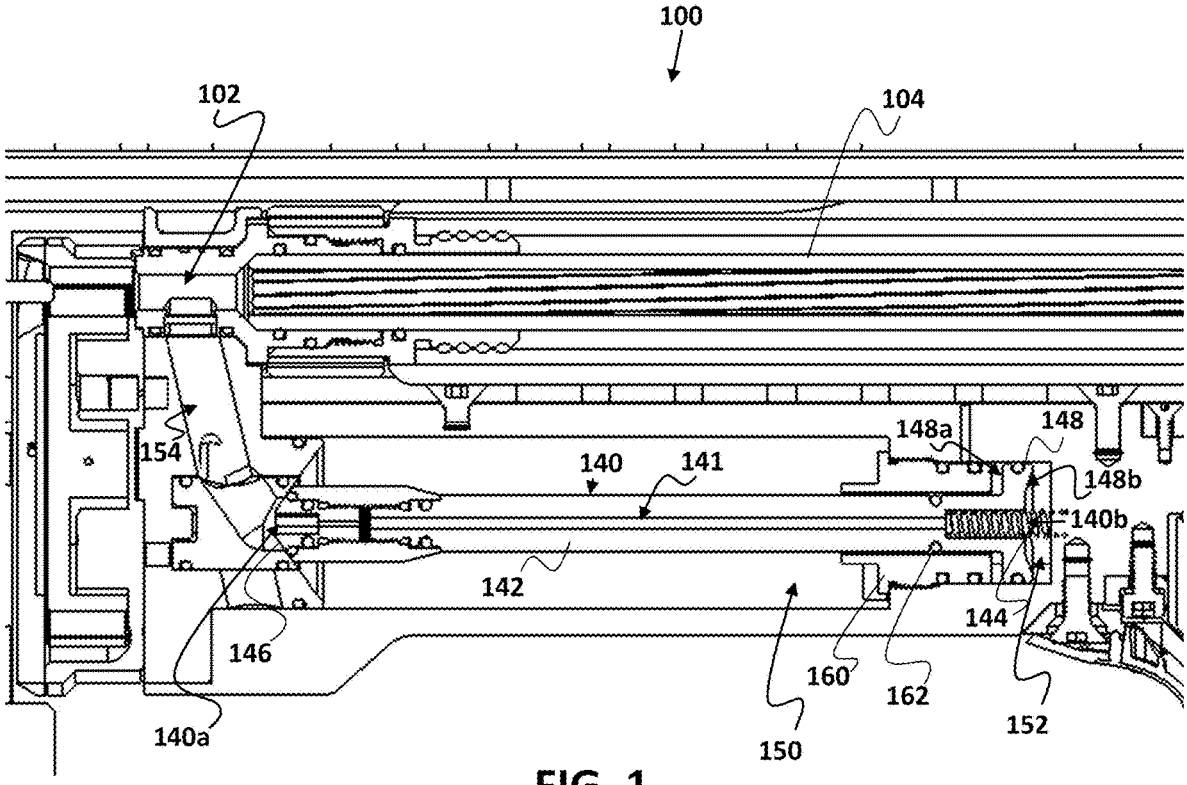
FIG. 1 is a somewhat schematic cross-sectional view of a pneumatic gun firing chamber and firing valve according to an embodiment of the principles of the present inventive concepts.
Figure 2:
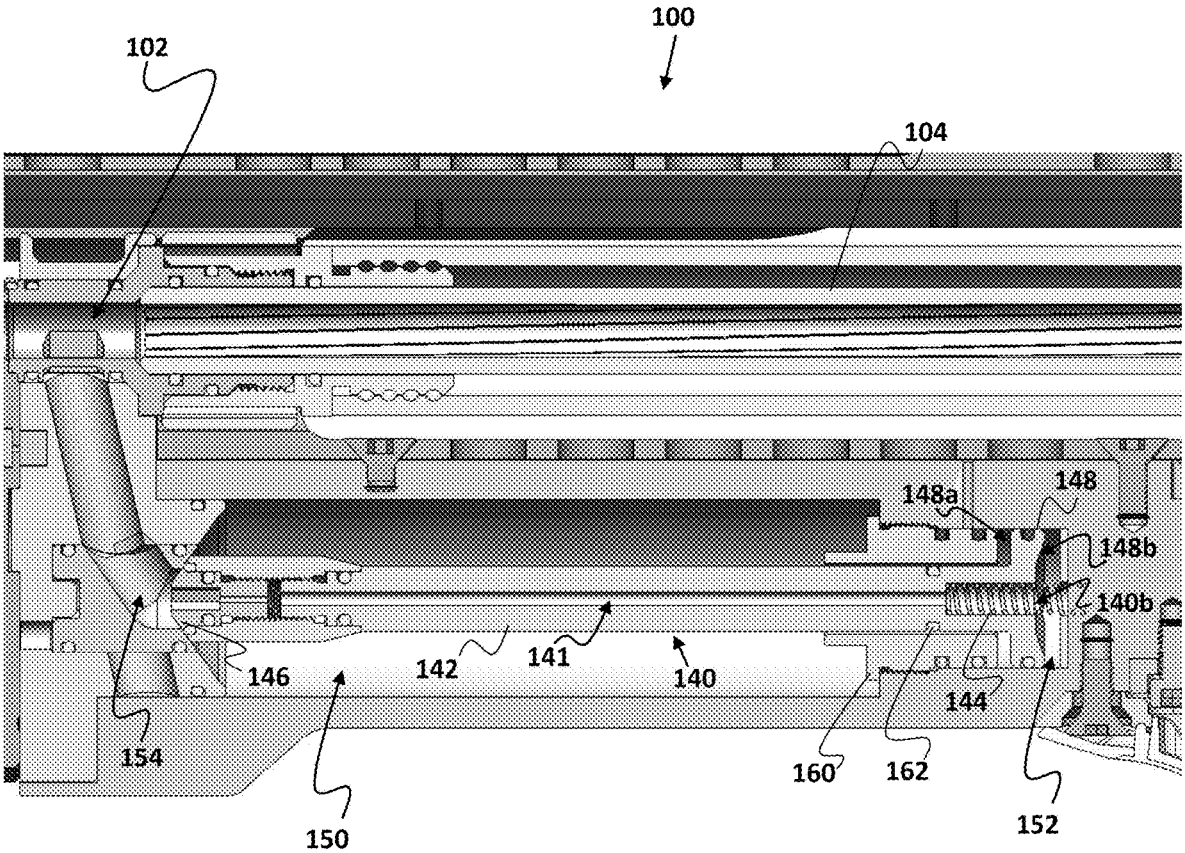
FIG. 2 is a somewhat schematic cross-sectional side view of a pneumatic gun firing chamber and firing valve of FIG. 1 with shading to help highlight features of the present inventive concepts.

FIGS. 1 and 2 are somewhat schematic cross-sectional side views of a compressed gas storage chamber 150 and firing valve 140 of an air (pneumatic) gun 100 according to an embodiment of the principles of the present inventive concepts. Referring to FIGS. 1 and 2, according to various embodiments and principles of the present invention, a firing valve 140 for an air gun comprises a substantially or completely balanced valve stem 142 that requires very little pressure to operate (i.e., move from a closed to open position). The valve stem 142 can, for example, be provided with a small amount of forward (i.e., direction of valve closure) bias (e.g., spring 144 or air bias (not shown)) to close the firing valve 140, or it can be completely balanced with neither a forward nor rearward bias.

In the embodiment shown, a spring 144 provides a force on the rearward end of the valve stem 142 to bias the firing valve 140 in a closed position. This is to ensure the valve is in the closed/sealed position before pressurizing, and can also allow the valve to work reliably over a wide operating range and friction levels. The spring 144, however, can be replaced with an air chamber 152 that is pressurized to bias the valve 140 closed, or the bias can be removed entirely (such as by providing a vented air chamber 152 behind the valve stem 142) to provide a completely balanced valve stem 142.

A valve 140 for a pneumatic gun includes a valve stem 142 arranged through a compressed gas storage area 150 that is configured to store a quantity of high-pressure compressed gas for a firing operation. The high-pressure gas could, for example, be between 500 to 2500 psi. A valve plug (poppet valve) 146 is arranged on a forward end of the valve stem 140 and seals an air port 154 that is configured to communicate compressed gas from a compressed gas storage area 150 to a breech 102. A piston 148 is arranged on a rearward end of the valve stem 140. A forward end 148*a* of the piston 148 receives a quantity of low-pressure compressed gas from a solenoid or mechanical valve (not shown) to initiate the firing operation of the pneumatic gun 100 by moving the valve stem 142 and connected poppet valve 146 rearward, thereby unseating the valve plug 146 and opening the firing valve 140. The low-pressure compressed gas from the solenoid or mechanical valve could, for example be around approximately 100-250 psi, or less. An air through-port 141 is arranged through the valve stem 142 from a forward end of the valve plug 146 to the piston 148 and communicates high-pressure compressed gas from the firing operation to a rearward end 148*b* of the piston 148 to assist in closing the valve plug 146. A cylinder 160 is arranged in communication with the compressed gas storage area 150 and surrounds the valve stem 140 to stabilize the forward and rearward movement of the valve stem 140.

More specifically, in one embodiment, a forward end of the valve stem 142 is connected to or provides a poppet valve 146 that operates to selectively trap and release high-pressure compressed gas from a compressed gas storage area 150 for the firing operation. A rearward end of the valve stem preferably comprises a piston 148 having a actuating surface 148*a* in communication with an air port that receives compressed gas from a solenoid valve or mechanical valve (not shown). The solenoid valve (or mechanical actuating valve) actuates the firing valve 140 by directing a low-pressure gas to the actuating surface 148*a* of the firing valve piston 148 in response to a trigger pull.

The valve stem 140 comprises an air through port 141 extending from a forward end of the valve stem 140*a* to a rearward end of the valve stem 140*b* that permits high-pressure compressed gas from the firing operation to assist in closing the firing valve 140. When the firing valve 140 is actuated, most of the compressed gas released through the firing valve 140 travels through one or more air transfer ports 154 to the breech of the air gun 100 to force a projectile from the barrel 104, providing more air expansion in the desired direction. However, some of the compressed gas from the compressed gas storage area 150 releases rearward through the air through port 141 in the valve stem 140 and provides a force on a rearward surface area 148*b* of the piston 148 arranged at the rearward end 140*b* of the valve stem 142 to close the firing valve 140.

By using some of the high-pressure gas from the firing operation to close the poppet valve 146, the firing valve 140 can be closed even against the lower actuating pressure from the solenoid valve or mechanical actuating valve. This permits the firing valve 140 to be closed faster and thereby conserves compressed gas and operates the air gun 100 more efficiently.

According to other aspects of the present inventive concepts, the firing valve 140 can include a larger poppet valve 146 compared to conventional firing valves, and particularly as compared to conventional hammer-actuated firing valves. For instance, the poppet valve 146 could be approximately about 0.420 inches in diameter or larger. The larger poppet valve 146 enables a quicker and more efficient release of the high-pressure compressed gas around the valve plug 146 of the firing valve 140. An O-ring 162 is arranged on a rearward portion of the valve stem 142 within the cylinder 160 that communicates with the compressed gas storage area, and should be sized to counter-balance the poppet valve 146 and provide a substantially or completely balanced valve stem 142. For instance, if the poppet valve 146 is 0.420 inches in diameter, this O-ring 162 provides a sealing bore or sealing diameter that could be approximately about 0.400 inches in diameter.

Of course, the inventive principles are not limited to the specific embodiments disclosed herein, and various aspects, embodiments, and configurations of this invention are possible without departing from the principles disclosed herein. This invention is therefore not limited to any of the particular aspects, embodiments, or configurations described herein.

For example, as explained previously, a straighter path could be provided between the firing valve 140 and the breech 102 of the air gun 100 to reduce or eliminate bends or turns between the firing valve 140 and the breech 102. For example, the valve poppet (plug) 146 could be moved closer to the barrel 104 and/or a straighter path could be provided between the firing valve 140 and the breech 102 of the air gun 100 to reduce or eliminate bends or turns between the firing valve 140 and the breech 102. In one embodiment, the firing valve 140 could be moved up into the air transfer port 154 between the compressed gas storage area 150 and the breech 102. In another embodiment, the firing valve 140 could be arranged directly behind the breech 102, such as in an extension of the breech chamber 102. Other embodiments could also be used to reduce or eliminate air turns and improve efficiency.

Furthermore, the air gun could be made semi- or fully-automatic by adding an automatic loading function to the air gun. A separate solenoid could be provided, for instance to operate a bolt for the loading function. The separate solenoid could be open or closed biased depending on the desired operation of the bolt. Numerous other changes or additions could be made to the air gun without departing from the principles of the present inventive concepts.

Having described and illustrated principles of the present invention in various preferred embodiments thereof, it should be apparent that the invention can be modified in arrangement and detail without departing from such principles.

What is claimed is:

1. A substantially-balanced firing valve for a pneumatic gun, comprising:

a valve stem arranged through a compressed gas storage area of the pneumatic gun, said compressed gas storage area configured to store a quantity of high-pressure compressed gas for a firing operation of the pneumatic gun;

a valve plug arranged on an end of the valve stem and configured to seal an air port arranged to communicate compressed gas from the compressed gas storage area to a breech of the pneumatic gun;

a piston arranged on an opposite end of the valve stem, wherein the piston is configured to receive a quantity of low-pressure compressed gas from a solenoid or mechanical actuating valve to initiate the firing operation of the pneumatic gun; and an air through-port arranged through the valve stem from the valve plug to the piston and configured to communicate high-pressure compressed gas from the firing operation through the air through-port to the piston to assist in closing the valve plug during a firing operation of the pneumatic gun.

2. A firing valve according to claim 1, further comprising a spring configured to bias the firing valve in a closed position.

3. A firing valve according to claim 1, further comprising an air chamber configured to bias the firing valve in a closed position.

4. A firing valve according to claim 1, wherein the firing valve is substantially completely balanced with no appreciable force biasing the firing valve in either an open or a closed position.

5. A firing valve according to claim 1, further comprising a cylinder that communicates with the compressed gas storage area and surrounds the valve stem to stabilize forward and rearward movement of the valve stem.

6. A firing valve according to claim 5, further comprising an O-ring arranged on the valve stem within the cylinder, wherein the O-ring is sized to counterbalance a force acting on the valve plug from the compressed gas storage area.

7. A firing valve according to claim 6, wherein the O-ring is approximately about 0.400 inches in diameter.

8. A firing valve according to claim 1, wherein the valve plug is approximately about 0.420 inches in diameter or larger.

9. A firing valve according to claim 1, wherein the high-pressure compressed gas in the compressed gas storage area is between approximately about 500 psi and 2500 psi.

10. A firing valve according to claim 1, wherein the low-pressure compressed gas is between approximately about 100 psi and 250 psi.

11. A pneumatic gun comprising:

a body having a breech in communication with a barrel;

a compressed gas storage area configured to house a quantity of high-pressure compressed gas;

an air port configured to communicate compressed gas from the compressed gas storage area to the breech to fire a projectile through the barrel during a firing operation of the pneumatic gun; and a firing valve configured to control the release of compressed gas from the compressed gas storage area to the breech, said firing valve comprising:

a valve stem arranged through the compressed gas storage area;

a valve plug arranged on a forward end of the valve stem and configured to seal the air port when closed;

a piston arranged on the valve stem, wherein the piston is configured to receive a quantity of low-pressure compressed gas to initiate the firing operation of the pneumatic gun; and an air through-port arranged through the valve stem and configured to communicate high-pressure compressed gas from the firing operation through the air through-port to the piston to assist in closing the valve plug during a firing operation of the pneumatic gun.

12. A pneumatic gun according to claim 11, further comprising:

an O-ring arranged on the valve stem within a cylinder in communication with the compressed gas storage area of the pneumatic gun, wherein the O-ring is sized to counterbalance a force acting on the valve plug.

13. A pneumatic gun according to claim 12, wherein the valve plug is approximately 0.420 inches in diameter or larger.

14. A pneumatic gun according to claim 13, wherein the O-ring is approximately about 0.400 inches in diameter or larger.

15. A pneumatic gun according to claim 11, wherein the high-pressure compressed gas in the compressed gas storage area is between approximately about 500 psi and 2500 psi, and wherein the low-pressure compressed gas acting on the piston is approximately between about 100 psi and 250 psi.

16. A method of operating a pneumatic gun, said method comprising:

supplying compressed gas to a compressed gas storage area, wherein a valve stem is arranged through the compressed gas storage area of the pneumatic gun, and wherein said compressed gas storage area is configured to store a quantity of high-pressure compressed gas for a firing operation of the pneumatic gun;

causing a valve plug arranged on the valve stem to seal an air port that is configured to communicate compressed gas from the compressed gas storage area to a breech of the pneumatic gun during the firing operation;

directing a quantity of low-pressure compressed gas from a solenoid or mechanical actuating valve to a piston arranged on the valve stem, wherein the piston initiates the firing operation of the pneumatic gun in response to the force created by the low-pressure compressed gas; and directing high-pressure compressed gas from the firing operation through an air through-port arranged through the valve stem from the valve plug to the piston to assist in closing the valve plug quickly after a firing operation of the pneumatic gun.

17. A method according to claim 16, wherein the valve plug is approximately 0.420 inches in diameter or larger.

18. A method according to claim 17, further comprising balancing a pressure acting on the valve stem from the compressed gas storage area using an O-ring, wherein the O-ring is approximately about 0.400 inches in diameter.

19. A method according to claim 16, wherein the high-pressure compressed gas in the compressed gas storage area is between approximately about 500 psi and 2500 psi.

20. A method according to claim 16, wherein the low-pressure compressed gas is between approximately about 100 psi and 250 psi.

* * * * *